US009611582B2

(12) United States Patent
Lee et al.

(10) Patent No.: US 9,611,582 B2
(45) Date of Patent: Apr. 4, 2017

(54) CLUTCH ASSEMBLY AND WASHING MACHINE HAVING THE SAME

(71) Applicant: SAMSUNG ELECTRONICS CO., LTD., Suwon-si, Gyeonggi-do (KR)

(72) Inventors: Seok Jin Lee, Hwaseong-si (KR); Yeong Man Kim, Suwon-si (KR); Jung Hwan Kim, Ulsan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1010 days.

(21) Appl. No.: 13/755,278

(22) Filed: Jan. 31, 2013

(65) Prior Publication Data

US 2013/0199247 A1 Aug. 8, 2013

(30) Foreign Application Priority Data

Feb. 3, 2012 (KR) ..... 10-2012-0011277

(51) Int. Cl.
*D06F 37/30* (2006.01)
*D06F 37/40* (2006.01)
*D06F 23/04* (2006.01)

(52) U.S. Cl.
CPC ..... *D06F 37/30* (2013.01); *D06F 37/40* (2013.01); *D06F 23/04* (2013.01)

(58) Field of Classification Search
CPC ..... D06F 37/40; D06F 37/304; D06F 23/04; D06F 33/02; D06F 37/30
USPC ..... 68/140, 12.24, 23.7, 133, 12.02, 131, 68/23.6, 23 R, 3 R; 192/12 BA, 18 R, 192/136, 26, 48.3, 103 B; 8/159, 137, 158
See application file for complete search history.

(56) References Cited

U.S. PATENT DOCUMENTS 4,157,042 A * 6/1979 McMillan ..... F16H 61/66245 474/13
5,551,262 A * 9/1996 Seo ..... D06F 37/40 192/84.3

(Continued)

FOREIGN PATENT DOCUMENTS

CN 1199113 11/1998
EP 1 508 727 2/2005

(Continued)

OTHER PUBLICATIONS

Chinese Office Action dated Sep. 1, 2016 from Chinese Patent No. 201310044245.X, 30 pages.

*Primary Examiner* — David Cormier
*Assistant Examiner* — Thomas Bucci
(74) *Attorney, Agent, or Firm* — Staas & Halsey LLP

(57) ABSTRACT

A washing machine includes a cabinet, a tub disposed within the cabinet, to store wash water, a rotating tub rotatably disposed within the tub, a pulsator rotatably disposed within the rotating tub, a motor disposed beneath the tub, to provide power for rotation of the rotating tub and the pulsator, and a clutch assembly disposed between the motor and the rotating tub. The clutch assembly includes a clutch coupling movable vertically between upper and lower positions to transmit the power from the motor to at least one of the rotating tub and the pulsator, a coupling lever movable pivotally to vertically move the clutch coupling, and a clutch lever movable pivotally and operatively connected to the coupling lever to pivotally move the coupling lever.

15 Claims, 10 Drawing Sheets

(56) References Cited

U.S. PATENT DOCUMENTS 6,049,930 A * 4/2000 Hisano ..... D06F 37/40 68/12.02
6,202,452 B1 * 3/2001 Ura ..... D06F 37/304 68/23.7
6,332,343 B1 * 12/2001 Koketsu ..... D06F 37/304 68/12.02
7,086,254 B2 * 8/2006 Lim ..... D06F 37/40 192/69.8
7,454,929 B2 * 11/2008 Cho ..... D06F 37/304 68/12.01
2008/0216521 A1 * 9/2008 Sanchez Dominguez ..... D06F 37/40 68/23.7
2010/0175437 A1 * 7/2010 Kim ..... D06F 37/206 68/23 R
2011/0186399 A1 8/2011 Bai et al.
2012/0137738 A1 * 6/2012 Lee ..... D06F 21/08 68/12.24

FOREIGN PATENT DOCUMENTS

| | | |
|---|---|---|
| JP | 8-98620 | 4/1996 |
| JP | 2002-113285 | 4/2002 |
| KR | 1999-009144 | 2/1999 |
| KR | 10-2005-0060678 | 6/2005 |
| KR | 20-0390934 | 7/2005 |
| KR | 10-2006-0062781 | 6/2006 |

* cited by examiner

CLUTCH ASSEMBLY AND WASHING MACHINE HAVING THE SAME

CROSS-REFERENCE TO RELATED APPLICATIONS

This application claims the benefit of Korean Patent Application No. 10-2012-11277 filed on Feb. 3, 2012 in the Korean Intellectual Property Office, the disclosure of which is incorporated herein by reference.

BACKGROUND

1. Field

Embodiments of the present disclosure relate to a clutch assembly for selectively transmitting power from a motor to a rotating tub and a pulsator, and a washing machine having the same.

2. Description of the Related Art

Washing machines are adapted to wash laundry using electric power. Such a washing machine generally includes a tub to store wash water, a rotating tub rotatably installed in the tub, a pulsator rotatably mounted on a bottom of the rotating tub, a motor and a clutch assembly. The motor and clutch assembly function to rotate the rotating tub and pulsator.

When the rotating tub and pulsator rotate in a state in which laundry and detergent water are supplied to the interior of the rotating tub, the pulsator stirs the laundry in the rotating tub together with wash water, to remove dirt attached to the laundry.

The clutch assembly, which is mounted to the washing machine, is connected to the rotating tub and pulsator, to selectively transmit power generated from the motor to the rotating tub and pulsator.

Washing machines are classified into two types in accordance with arrangement of a clutch assembly and a motor. In the first type of washing machine, the clutch assembly and motor are eccentrically arranged, and are connected by a belt to drive the washing machine. In this type, however, the center of weight of the washing machine is biased from the axial center of the washing machine. That is, the weight of the washing machine is unbalanced. In the second type of washing machine, the clutch assembly and motor are connected in series. In this type, however, the driving part of the washing machine may be enlarged.

SUMMARY

Therefore, it is an aspect of the present disclosure to provide a clutch assembly having a simple structure and a washing machine having the same.

Additional aspects of the disclosure will be set forth in part in the description which follows and, in part, will be apparent from the description, or may be learned by practice of the disclosure.

In accordance with one aspect of the present disclosure, a washing machine includes a cabinet, a tub disposed within the cabinet, to store wash water, a rotating tub rotatably disposed within the tub, a pulsator rotatably disposed within the rotating tub, a motor disposed beneath the tub, to provide power for rotation of the rotating tub and the pulsator, and a clutch assembly disposed between the motor and the rotating tub, wherein the clutch assembly includes a clutch coupling movable vertically between upper and lower positions to transmit the power from the motor to at least one of the rotating tub and the pulsator, a coupling lever movable pivotally to vertically move the clutch coupling, and a clutch lever movable pivotally and operatively connected to the coupling lever to pivotally move the coupling lever.

The clutch lever may include a stopper to limit a pivotal movement range of the clutch lever.

The clutch lever may further include an elastic member to elastically bias the clutch lever in one side.

The clutch lever may include a lever guide to selectively contact the coupling lever, for the operative connection of the clutch lever to the coupling lever.

The lever guide may push the coupling lever, to pivotally move the coupling lever.

The lever guide may include a contact protrusion to enable the coupling lever to move pivotally while being smoothly pushed by the lever guide.

The clutch lever may move pivotally on a horizontal plane.

The coupling lever may move pivotally a vertical plane in a state of being operatively connected to the clutch lever.

The coupling lever may include a coupling guide provided at a lower end of the coupling lever, to vertically move the clutch coupling.

The clutch assembly may include a washing shaft connected to the motor, to transmit the power from the motor to the pulsator, and a spin-drying shaft connected to the clutch coupling, to rotate the rotating tub when the clutch coupling rotates.

The washing machine may further include a clutch boss coupled to a lower end of the washing shaft, to rotate together with the washing shaft.

The clutch coupling may downwardly move to the lower position in accordance with corresponding pivotal movements of the clutch lever and the coupling lever operatively connected to the clutch lever. The clutch coupling may be coupled to the clutch boss at the lower position of the clutch coupling. The washing shaft, the clutch boss and the clutch coupling may be rotated by the power from the motor in accordance with the coupling of the clutch coupling to the clutch boss. The spin-drying shaft may be rotated in accordance with the rotation of the clutch coupling. The pulsator may be rotated in accordance with the rotation of the washing shaft, and the rotating tub may be rotated in accordance with the rotation of the spin-drying shaft.

The clutch coupling may move upwardly to the upper position in accordance with corresponding pivotal movements of the clutch lever and the coupling lever operatively connected to the clutch lever. The clutch coupling may be separated from the clutch boss at the upper position of the clutch coupling. The washing shaft may be rotated by the power from the motor, and the clutch coupling and the spin-drying shaft may not rotate in accordance with the separation of the clutch coupling from the clutch boss. The pulsator may be rotated in accordance with the rotation of the washing shaft, and the rotating tub may be maintained in a stopped state.

The clutch boss may be separate from the motor.

In accordance with another aspect of the present disclosure, a washing machine includes a cabinet, a tub disposed within the cabinet, to store wash water, a rotating tub rotatably disposed within the tub, a pulsator rotatably disposed within the rotating tub, a motor disposed beneath the tub, to provide power for rotation of the rotating tub and the pulsator, and a clutch assembly disposed between the motor and the rotating tub, wherein the clutch assembly comprises a clutch coupling movable vertically between upper and lower positions to transmit the power from the motor to at least one of the rotating tub and the pulsator, and a clutch boss disposed beneath the clutch coupling such that the clutch boss is separated from the clutch coupling when the clutch coupling moves upwardly to the upper position, while being coupled to the clutch coupling when the clutch coupling moves downwardly to the lower position.

The clutch boss may be separate from the motor.

The rotating tub and the pulsator may simultaneously rotate when the clutch boss is coupled to the clutch coupling. Only the rotating tub may rotate when the clutch boss is separated from the clutch coupling.

The clutch assembly may further include a coupling lever movable pivotally to vertically move the clutch coupling.

The clutch assembly may further include a clutch lever movable pivotally and operatively connected to the coupling lever to pivotally move the coupling lever.

In accordance with another aspect of the present disclosure, a clutch assembly includes first and second rotating shafts, a clutch boss connected to the first rotating shaft, to rotate together with the first rotating shaft, a clutch coupling coupled to the second rotating shaft, to rotate together with the second rotating shaft, the clutch coupling being vertically movable between upper and lower positions, and a clutch lever to selectively pivotally move the coupling lever, the clutch lever being pivotally movable between a first position, at which the clutch lever contacts the coupling lever, to press the coupling lever, and a second position, at which the clutch lever is spaced apart from the coupling lever.

The coupling lever may be pivotally moved to upwardly move the clutch coupling to the upper position when the clutch lever moves pivotally to the first position, thereby causing the clutch coupling to be separated from the clutch boss.

The coupling lever may be pivotally moved to downwardly move the clutch coupling to the lower position when the clutch lever moves pivotally to the second position, thereby causing the clutch coupling to be coupled to the clutch boss.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
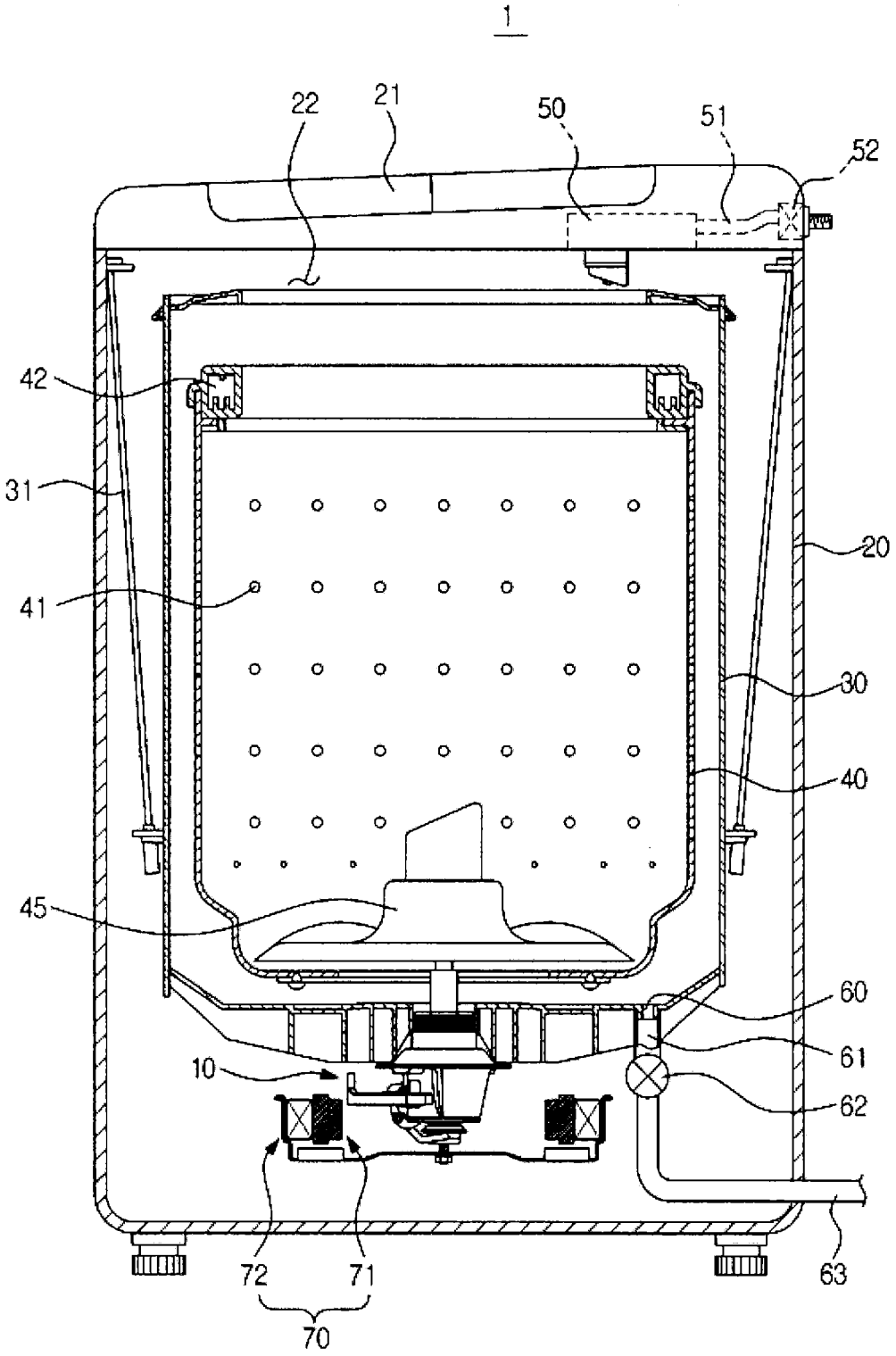
FIG. 1 is a sectional view illustrating a washing machine according to an exemplary embodiment of the present disclosure.

Hereinafter, embodiments of the present disclosure will be described with reference to the accompanying drawings, wherein like reference numerals refer to the like elements throughout. The embodiments are described below to explain the present disclosure by referring to the figures.

FIG. 1 is a sectional view illustrating a washing machine according to an exemplary embodiment of the present disclosure.

As shown in FIG. 1, the washing machine, which is designated by reference numeral "1", includes a cabinet 20 to form an appearance of the washing machine 1, a tub 30 disposed within the cabinet 20, to store wash water, and a rotating tub 40 rotatably disposed within the tub 30. The washing machine 1 also includes a pulsator 45 disposed within the rotating tub 40, to generate a stream of water.

A laundry inlet 22 is formed through a top of the cabinet 20, to allow loading of laundry into the rotating tub 40. The laundry inlet 22 is opened or closed by a door 21 mounted to the top of the cabinet 20.

The tub 30 is supported by the cabinet 20 in a suspended state, using a suspension device 31. The suspension device 31 connects a lower portion of an outer surface of the tub 30 and an upper portion of an inner surface of the cabinet 20. The suspension device 31 attenuates vibration generated at the cabinet 20 or tub 30 during a washing operation or a spin drying operation.

A water supply tube 51 is installed at a top of the tub 30, to supply wash water. The water supply tube 51 is connected, at one end thereof, to an external water supply source (not shown) while being connected, at the other end thereof, to a detergent supplier 50. Water supplied through the water supply tube 51 is supplied to the interior of the tub 30 via the detergent supplier 50. A water supply valve 52 is installed at the water supply tube 51, to control supply of water.

The rotating tub 40 has an upwardly-opened cylindrical structure. A plurality of holes 41 is formed through a side wall of the rotating tub 40 such that the inner space of the rotating tub 40 communicates with the inner space of the tub 30.

A balancer 42 may be mounted to a top of the rotating tub 40, to offset unbalance of weight occurring at the rotating tub 40 during high-speed rotation of the rotating tub 40, and thus to enable the rotating tub 40 to rotate stably.

The pulsator 45 rotates normally or reversely, to generate a stream of water. By the generated water stream, laundry loaded in the rotating tub 40 is stirred together with wash water, A drainage hole 60 is formed through a bottom of the tub 30, to drain wash water stored in the tub 30. A first drainage tube 61 is connected to the drainage hole 60. A drainage valve 62 is installed at the first drainage tube 61, to control drainage of wash water.

The drainage valve 62 is connected, at an outlet thereof, to a second drainage tube 63 to drain wash water to outside. The drainage valve 62 may be implemented by various devices such as a solenoid device or a linkage device connected to a motor.

A motor 70 including a stator 71 and a rotor 72 is arranged beneath the tub 30. The motor 70 generates drive force upon receiving electric power. A clutch assembly 10 is arranged between the motor 70 and the tub 30, to selectively transmit drive force from the motor 70 to the tub 30 or the pulsator 45.

In particular, the illustrated embodiment employs a direct connection type arrangement in which the motor 70 and clutch assembly 10 are vertically aligned.

Figure 2:
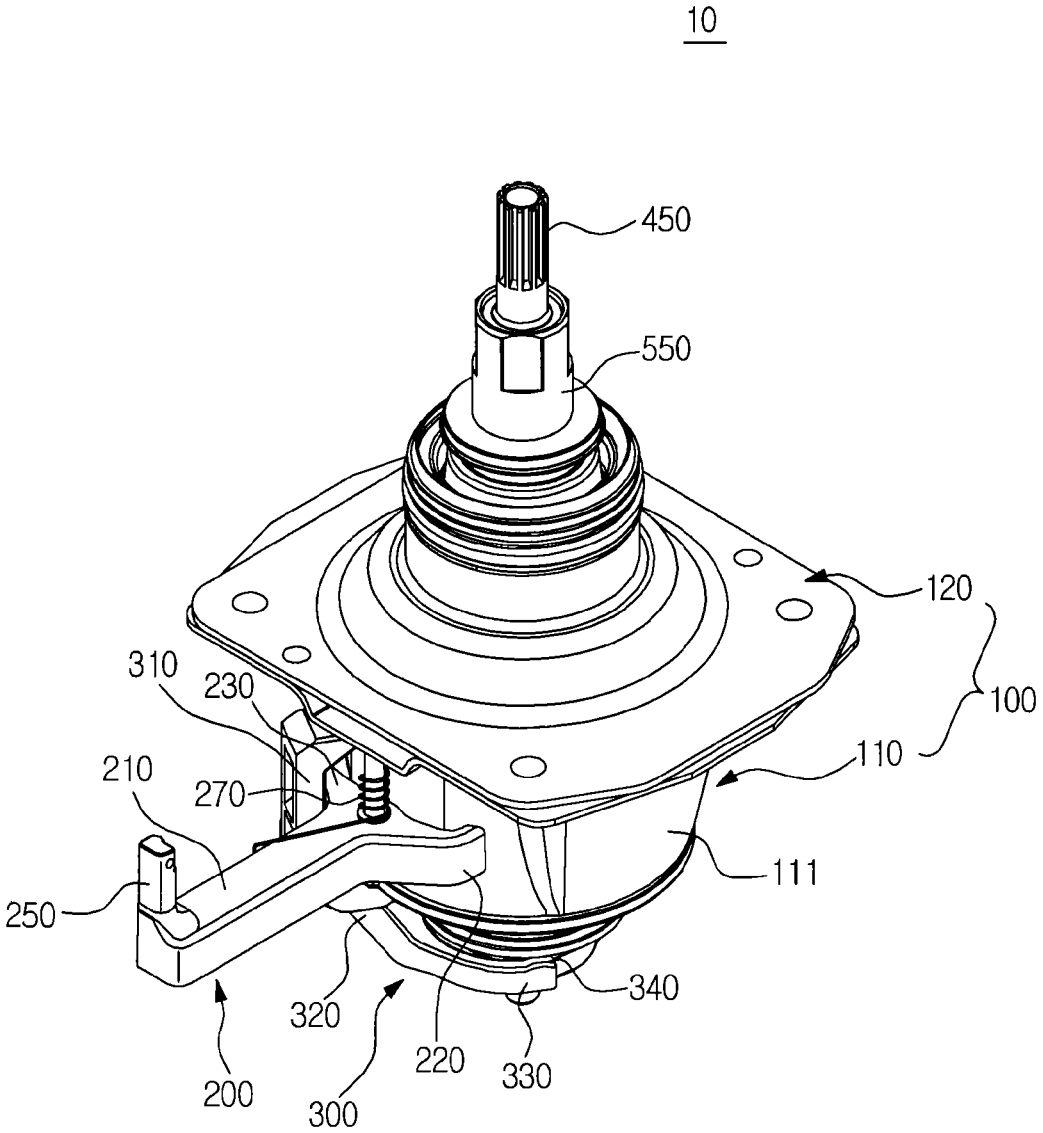
FIG. 2 is a view illustrating a clutch assembly according to an embodiment of the present disclosure.
Figure 3:
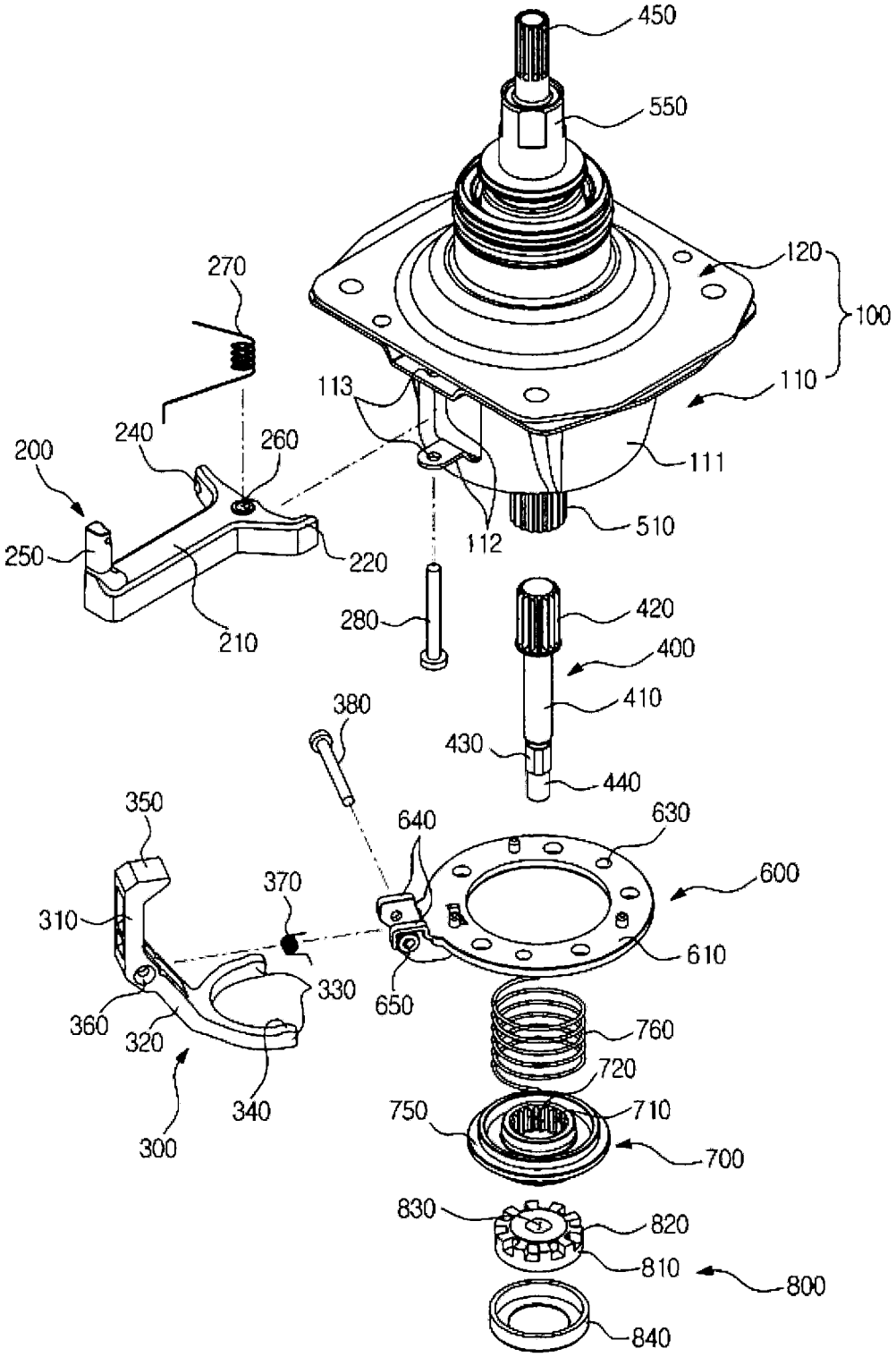
FIG. 3 is an exploded perspective view illustrating a configuration of the clutch assembly according to the illustrated embodiment.

FIG. 2 is a view illustrating a clutch assembly according to an embodiment of the present disclosure. FIG. 3 is an exploded perspective view illustrating a configuration of the clutch assembly according to the illustrated embodiment.

As shown in FIGS. 2 and 3, the clutch assembly 10 includes a housing 100 to form an appearance of the clutch assembly 10. The housing 100 includes an upper housing 120 and a lower housing 110 which are coupled. A washing shaft 450 and a spin-drying shaft 550 extend upwardly through a top of the housing 100.

The spin-drying shaft 550 has a centrally-hollow cylindrical structure. The washing shaft 450 may be inserted into a hollow of the spin-drying shaft 550. The washing shaft 450 and spin-drying shaft 550 are coupled to rotate simultaneously or separately. The washing shaft 450 extends upwardly beyond the spin-drying shaft 550, and is coupled to the pulsator 45 (FIG. 1). The spin-drying shaft 550 is coupled to the rotating tub 40 (FIG. 1). The washing shaft 450 rotates the pulsator 45, whereas the spin-drying shaft 550 rotates the rotating tub 40.

A housing gear 510 may be formed at a bottom of the housing 100. The housing gear 510 is downwardly protruded from the bottom of the housing 100. The housing gear 510 may be connected to the spin-drying shaft 550 within the housing 100. That is, when the housing gear 510 rotates, the spin-drying shaft 550 and the rotating tub 40 connected to the spin-drying shaft 550 are rotated.

The housing gear 510 may be formed to be centrally hollow. A lower shaft 400 may be inserted into a hollow of the housing gear 510. The lower shaft 400 extends through the hollow of the housing gear 510, and is connected to the washing shaft 450. Accordingly, when the lower shaft 400 rotates, the washing shaft 450 and the pulsator 45 (FIG. 1) coupled to the washing shaft 450 are rotated.

The lower shaft 400 includes a shaft body 410 having a rod shape. A shaft gear 420 may be formed at an upper portion of the shaft body 410. The shaft gear 420 may be coupled to a gearing (not shown) provided within the housing 100. The gearing (not shown) may include at least one gear, to control rotation speeds of the lower shaft 400 and washing shaft 450 through control of the gear ratio thereof to the shaft gear 420 of the lower shaft 400 such that the rotation speeds of the lower shaft 400 and washing shaft 450 are equal or different.

A boss coupler 430 may be formed at a lower portion of the shaft body 410 in order to couple the shaft body 410 to a clutch boss 800. The boss coupler 430 may have a polygonal cross section other than a circular cross section, for firm coupling thereof to the clutch boss 800. In another embodiment, the cross section of the boss coupler 430 may be circular or various polygonal shapes.

The shaft body 410 is coupled, at a lower end 440 thereof, to a rotor 72 (FIG. 1) of the motor 70 (FIG. 1). Accordingly, when the motor 70 rotates, the lower shaft 400 is rotated.

The clutch boss 800 includes a boss body 810, and a shaft coupling hole 830 centrally formed through the boss body 810. The shaft coupling hole 830 has a shape corresponding to the shape of the boss coupler 430 of the shaft body 410 in order to enable the lower shaft 400 and clutch boss 800 to be firmly coupled. It may be necessary to firmly couple the clutch boss 800 to the lower shaft 400 in order to transmit rotation force from the lower shaft 400 rotated by the motor 70 (FIG. 1) to the rotating tub 40 (FIG. 1) via a clutch coupling 700, the housing gear 510 and the spin-drying shaft 550.

A plurality of boss protrusions 820 is formed at an upper surface of the boss body 810. The boss protrusions 820 are engaged with coupling protrusions 730 (FIG. 4) of the clutch coupling 700.

A boss rubber 840 may be fitted around a lower portion of the boss body 810, to reduce noise generated at the clutch boss 800 during rotation of the clutch boss 800. The boss rubber 840 may cover lower and side surfaces of the boss body 810.

The clutch boss 800 may be formed separately from the motor 70 (FIG. 1). When the clutch boss 800 is formed separately from the motor 70, it may be possible to easily apply the clutch assembly 10 to various types of motors. That is, the clutch assembly 10 may be applied to various types of motors by simply changing the shape of the clutch boss 800 without changing the remaining configurations of the clutch assembly 10.

For example, although the clutch assembly 10 illustrated in the drawings is of a direct connection type in which the clutch assembly 10 is vertically aligned with the motor 70, the clutch assembly 10 may be of a parallel type in which the clutch assembly 10 is arranged in parallel with the motor 70. In this case, only the shape of the clutch boss 800 may be changed to form a groove to hold a belt for connection to the motor 70, without change of other configurations.

The clutch coupling 700 is arranged between the bottom of the housing 100 and the clutch boss 800. The clutch coupling 700 will be described hereinafter with reference to the drawings.

Figure 4:
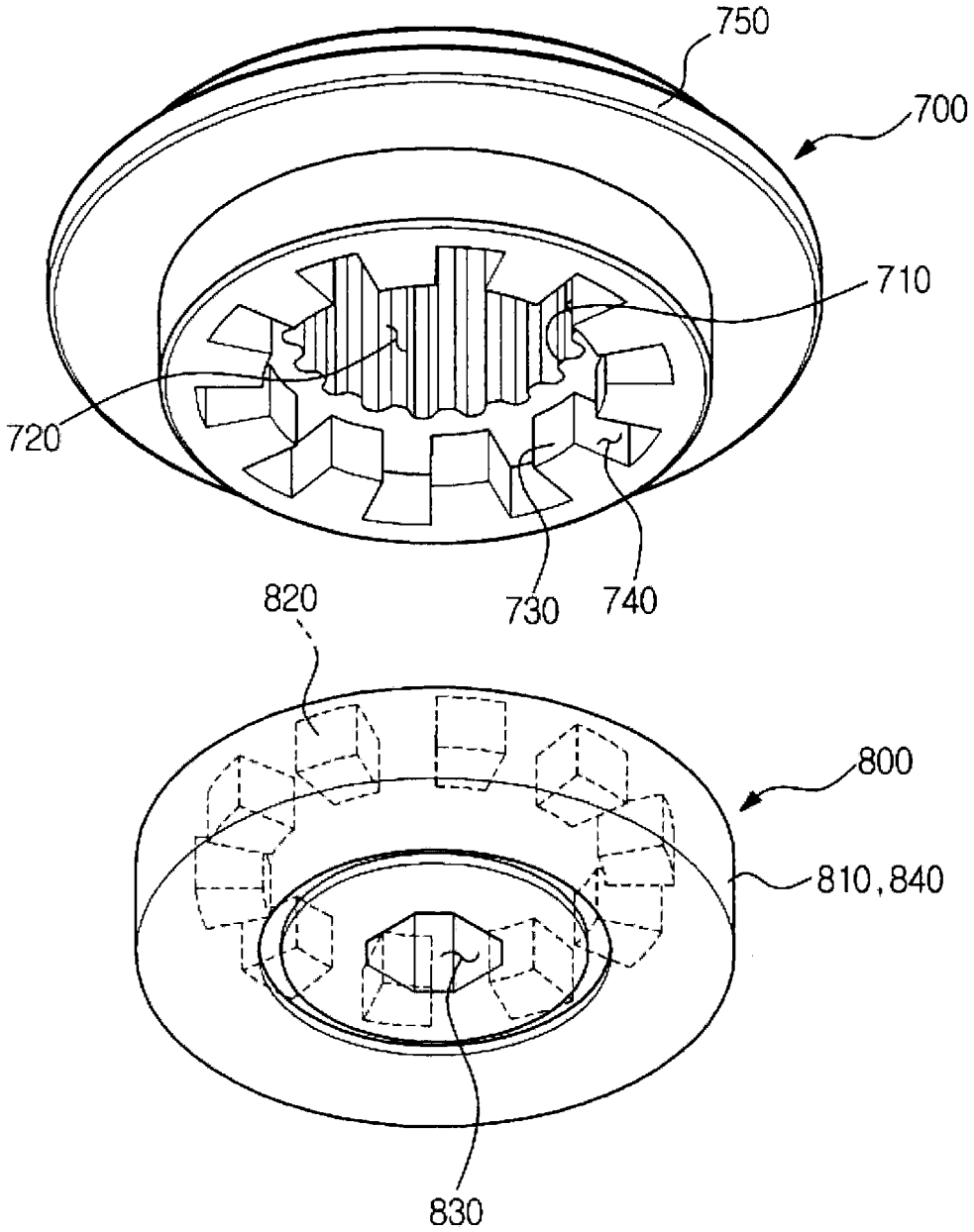
FIG. 4 is a perspective view illustrating a clutch coupling and a clutch boss, which are included in the clutch assembly shown in FIG. 2.

FIG. 4 is a perspective view illustrating the clutch coupling and clutch boss of the clutch assembly shown in FIG. 2.

As shown in FIGS. 3 and 4, the clutch coupling 700 is coupled to the clutch boss 800, to receive driver force from the motor 70 via the lower shaft 400 and clutch boss 800, and then to transmit the driver force to the housing gear 510, spin-drying shaft 550 and rotating tub 40 (FIG. 1).

The clutch coupling 700 includes a shaft hole 720 centrally formed through the clutch coupling 700. Through the shaft hole 720, the body of the lower shaft 400 extends. Coupling teeth 710 are formed at an inner surface of the shaft hole 720, to be engaged with the housing gear 510.

A seat 750 is formed around a middle portion of the clutch coupling 700, to extend radially outwardly. A coupling elastic member 760 is seated on an upper surface of the seat 750. A coupling lever 300 is in contact with a lower surface of the seat 750.

The coupling protrusions 730 are formed at a lower surface of the clutch coupling 700, to extend radially inwardly. Coupling grooves 740 are also formed at the clutch coupling 700 such that each coupling groove 740 is arranged between the adjacent coupling protrusions 730. The coupling protrusions 730 are shaped to make the coupling grooves 740 have a shape corresponding to that of the boss protrusions 820 of the clutch boss 800.

The clutch coupling 700 is arranged beneath the housing 100 such that the coupling teeth 710 are engaged with the housing gear 510. The lower shaft 400 extends through the shaft hole 720, to be is coupled to the clutch boss 800 beneath the clutch coupling 700.

The coupling teeth 710 are slidable along teeth of the housing gear 510. Accordingly, the clutch coupling 700 is vertically slidable.

When the clutch coupling 700 moves downwardly to a lower position thereof, the boss protrusions 820 of the clutch boss 800 are engaged with the coupling grooves 740 of the coupling teeth 710. As a result, the clutch coupling 700 is coupled to the clutch boss 800. Accordingly, when the lower shaft 400 is rotated by the motor 70 (FIG. 1), the clutch boss 800 coupled with the lower shaft 400 is rotated, thereby causing the clutch coupling 700 to rotate. When the clutch coupling 700 rotates, the housing gear 510 engaged with the coupling teeth 710 is rotated, thereby causing the spin-drying shaft 550 and rotating tub 40 (FIG. 1) to rotate.

On the other hand, when the clutch coupling 700 moves upwardly to an upper position thereof, the clutch coupling 700 is spaced apart from the clutch boss 800, to be separated from the clutch boss 800. In this state, accordingly, the clutch coupling 700 is not rotated. As a result, the housing gear 510, spin-drying shaft 550 and rotating tub 40 are not rotated.

Figure 5:
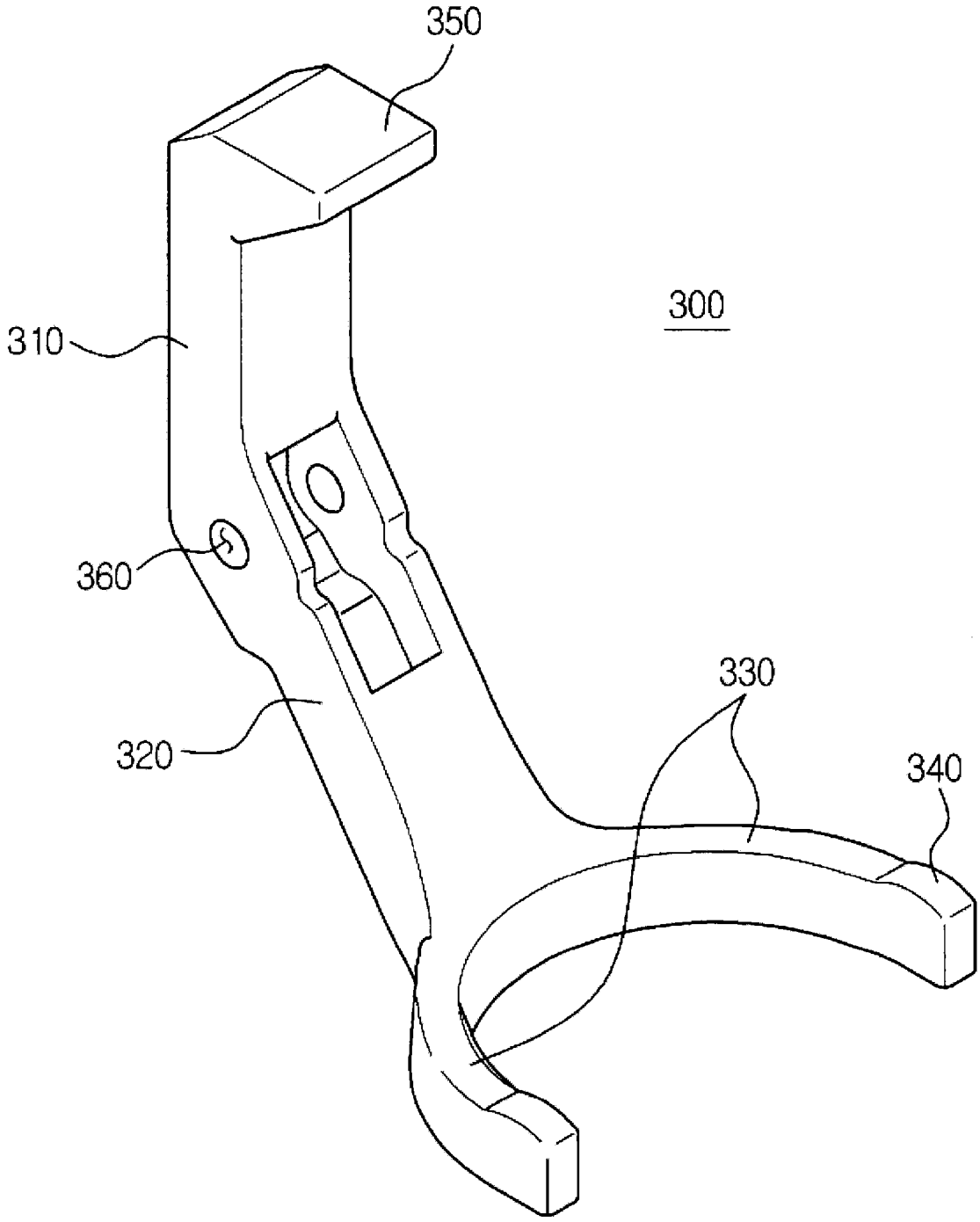
FIG. 5 is a perspective view illustrating a coupling lever included in the clutch assembly shown in FIG. 2.

FIG. 5 is a perspective view illustrating the coupling lever of the clutch assembly shown in FIG. 2.

As shown in FIGS. 3 and 5, the coupling lever 300 includes an upper lever portion 310 and a lower lever portion 320. The upper and lower lever portions 310 and 320 are inclined from each other to form a predetermined angle about first rotation center holes 360 formed between the upper and lower lever portions 310 and 320.

A coupling guide 330 may be forwardly protruded from a lower end of the lower lever portion 320. The coupling guide 330 may be divided into two legs extending from the lower lever portion 320. The legs of the coupling guide 330 may form an annular shape opened at one side thereof.

A first contact protrusion 340 is upwardly protruded from an end of each leg of the coupling guide 330. The first contact protrusion 340 contacts the lower surface of the seat 750 of the clutch boss 800.

A first stopper 350 may be forwardly protruded from an upper end of the upper lever portion 310. The first stopper 350 selectively contacts a side surface 111 of the housing 100, to limit pivotal movement of the coupling lever 300.

The coupling lever 300 is pivotally mounted to a lever holder 600. The lever holder 600 is mounted to a lower surface of the lower housing 110. The lever holder 600 includes an annular holder plate 610 to form an appearance of the lever holder 600.

The folder plate 610 is provided with a pair of first mounting portions 640 spaced apart from each other by a certain distance. A first mounting hole 650 is formed through each first mounting portion 640. The coupling lever 300 is coupled to the lever holder 600 such that the first rotation center holes 360 are arranged between the first mounting portions 640. A first elastic member 370 is interposed between the first rotation center holes 360. A first coupling pin 380 extends through one first mounting hole 650, the first rotation center holes 360, the first elastic member 370 and the other first mounting hole 650, to couple the coupling lever 300 and lever holder 600.

The coupling lever 300 is pivotally movable about the first rotation center holes 360, to upwardly or downwardly move the coupling guide 330.

The coupling guide 330 of the coupling lever 300 comes into contact with the clutch coupling 700, to upwardly or downwardly move the clutch coupling 700.

The first elastic member 370 always urges the coupling lever 300 by elasticity thereof, to downwardly move the coupling guide 330 of the coupling lever 300.

A plurality of coupling holes 630 may be formed through the holder plate 610. A fastening member (not shown) may be inserted into the lower housing 110 through each coupling hole 630, to couple the lever holder 600 to the housing 100.

Figure 6:
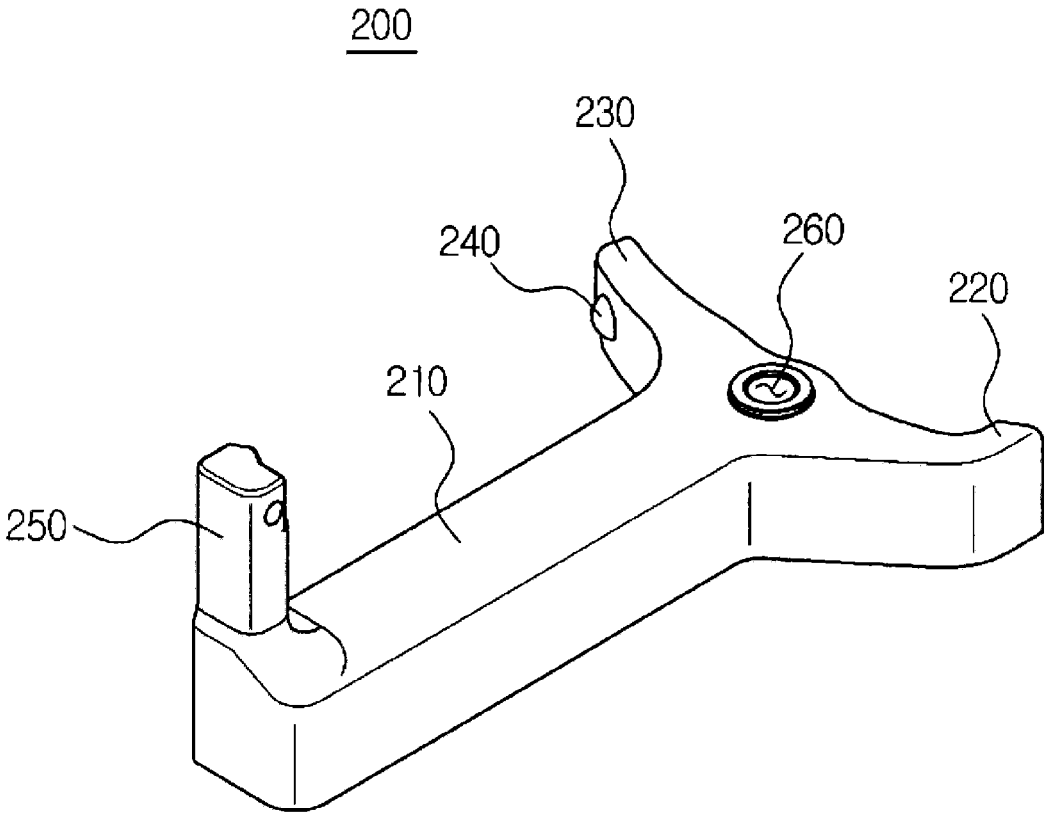
FIG. 6 is a perspective view illustrating a clutch lever included in the clutch assembly shown in FIG. 2.

FIG. 6 is a perspective view illustrating the clutch lever of the clutch assembly shown in FIG. 2.

As shown in FIGS. 2 and 6, the clutch lever 200 is mounted to the side surface 111 of the housing 100, to pivotally move in a horizontal direction about a second rotation center hole 260 formed at an end of a lever body 210. The housing side surface 111 is formed with a pair of second mounting portions 112 spaced apart from each other by a certain distance, for mounting of the clutch lever 200. A second mounting hole 113 is formed through each second mounting portion 112. The clutch lever 200 is mounted to the second mounting portions 112 such that the second rotation center hole 260 is arranged between the second mounting portions 112. A second elastic member 270 is interposed between the second rotation center hole 260 and one of the second mounting holes 113. A second coupling pin 280 extends through the second mounting hole 113, second rotation center holes 260 and second elastic member 270, to couple the clutch lever 200 and housing 100.

A lever guide 230 and a second stopper 220 may be formed at one end of the lever body 210. The lever guide 230 and second stopper 220 extend from the end of the lever body 210 in opposite directions at opposite sides of the second rotation center hole 260, respectively.

The lever guide 230 and second stopper 220 are arranged adjacent to the housing side surface 111. In particular, the second stopper 220 is bent toward the housing side surface 111.

The lever guide 230 selectively comes into contact with the upper lever portion 310 of the coupling lever 300. In particular, the lever guide 230 selectively comes into contact with the upper lever portion 310 at a surface of the lever guide 230 opposite to a surface of the lever guide 230 facing the housing side surface 111. A second contact protrusion 240 is protruded from a portion of the lever guide 230 adjacent to the upper lever portion 310.

A connector 250 is formed at the other end of the lever body 210 opposite to the end of the lever body 210 formed with the lever guide 230 and second stopper 220. A lever driver (not shown) to drive the clutch lever 200 is connected to the connector 250.

The clutch lever 200 is pivotable about the second rotation center hole 260 in a horizontal direction. The second elastic member 270 always urges the clutch lever 200 toward the second stopper 200. Accordingly, the second stopper 220 is in contact with the housing side surface 111 when no external force is applied to the clutch lever 200.

When the clutch lever 200 pivotally moves toward the second stopper 220, the lever guide 230 pushes the upper lever portion 310 of the coupling lever 300, thereby causing the coupling guide 330 to move upwardly. As a result, the clutch coupling 700 is upwardly moved. In accordance with the upward movement, the clutch coupling 700 is separated from the clutch boss 800.

The clutch coupling 700 and coupling guide 330 are always downwardly pressed by the elastic force of the first elastic member 370 and coupling elastic member 760. Accordingly, the clutch coupling 700 and coupling guide 330 may be upwardly moved only when a higher force than the pressing force is applied in an upward direction to the clutch coupling 700 and coupling guide 330. Therefore, the elastic force of the second elastic member 270 should be higher than the sum of the elastic force of the first elastic member 370 and the elastic force of the coupling elastic member 760.

On the other hand, when the clutch lever 200 is pivotally moved toward the lever guide 230 against the elastic force of the second elastic member 270 by the lever driver (not shown), the lever guide 230 is spaced apart from the upper lever portion 310 while no longer pushing the upper lever portion 310.

When external force applied to the coupling lever 300 is released, the coupling lever 300 is pivotally moved by the elastic force of the second elastic member 270 and the elastic force of the coupling elastic member 760, thereby causing the coupling guide 330 to be downwardly moved. Accordingly, the clutch coupling 700 is also downwardly moved. When the clutch coupling 700 is downwardly moved, it is coupled to the clutch boss 800. Thus, the clutch coupling 700 and clutch boss 800 rotate simultaneously.

Figure 7:
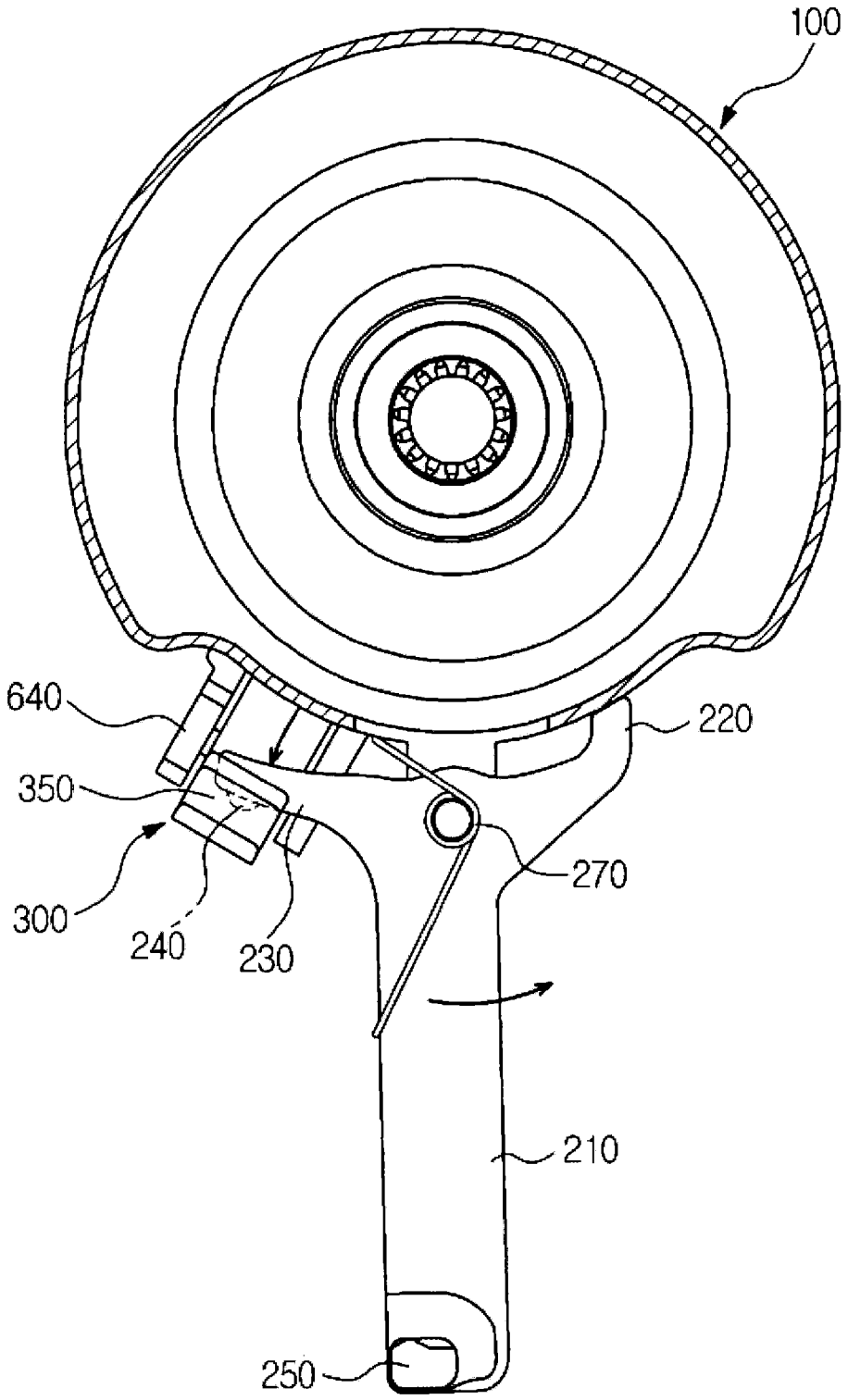
FIGS. 7 and 8 are views illustrating operation of the clutch assembly during washing in accordance with an embodiment of the present disclosure.
Figure 8:
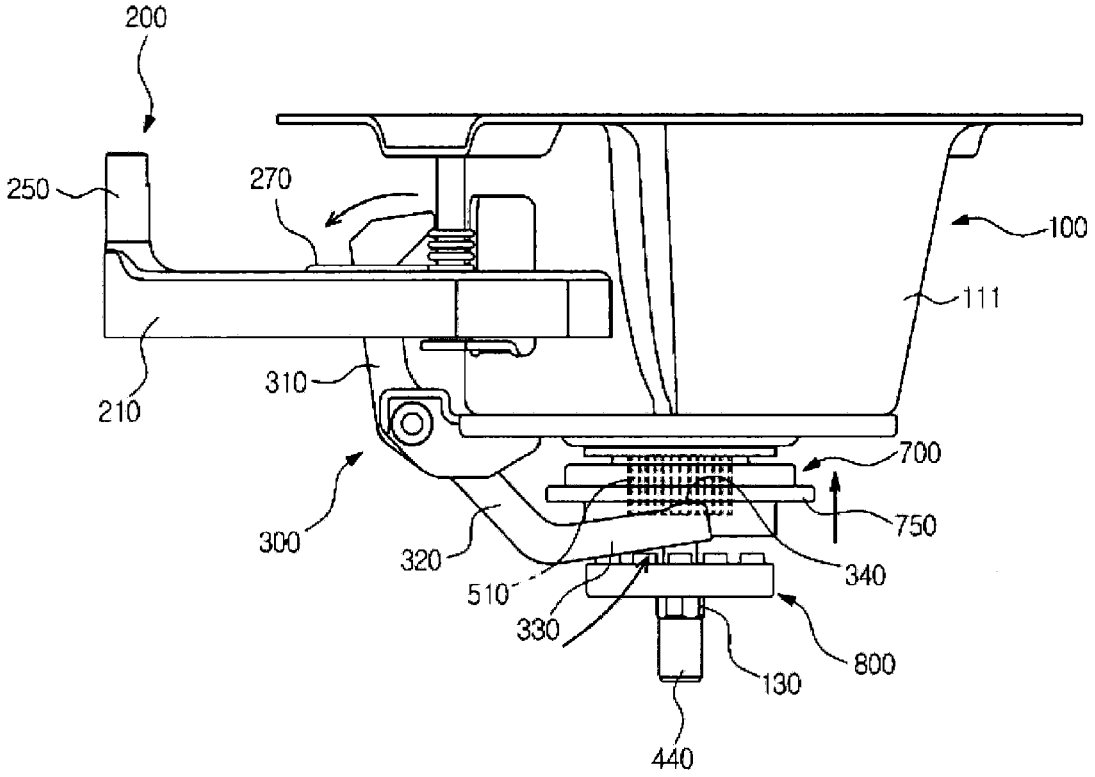

FIGS. 7 and 8 are views illustrating operation of the clutch assembly during washing in accordance with an embodiment of the present disclosure.

During washing, the rotating tub 40 (FIG. 1) does not rotate, and only the pulsator 45 (FIG. 1) disposed within the rotating tub 40 rotates.

As shown in FIGS. 3, 7 and 8, the clutch lever 200 is pivotally moved in an extension direction of the second stopper 220 by the elastic force of the second elastic member 270. The pivotal movement of the clutch lever 200 is carried out until the second stopper 220 comes into contact with the housing side surface 111.

In accordance with the pivotal movement of the clutch lever 200, the lever guide 230 is pivotally moved away from the housing side surface 111 while pushing the upper lever portion 310 of the coupling lever 300 in a direction away from the housing side surface 111.

In particular, the second contact protrusion 240 formed at the lever guide 230 pushes the upper lever portion 310, thereby causing the upper lever portion 310 to slide along a hemispherical surface of the second contact protrusion 240. Accordingly, the coupling lever 300 is smoothly pivotally moved.

When the upper lever portion 310 is pushed, as described above, the coupling guide 330 is upwardly moved. In accordance with the upward movement of the coupling guide 330, the first contact protrusions 340 upwardly push the lower surface of the seat 750. As a result, the clutch coupling 700 is upwardly moved. In accordance with the upward movement, the clutch coupling 700 is separated from the clutch boss 800.

The lower shaft 400 connected to the motor 70 (FIG. 1) is rotated by drive force from the motor 70. In accordance with rotation of the lower shaft 400, the clutch boss 800 and washing shaft 450, which are connected to the lower shaft 400, are rotated. When the washing shaft 450 rotates, the pulsator 45 (FIG. 1) also rotates.

On the other hand, the clutch coupling 700 does not rotate because the drive force from the motor 70 (FIG. 1) is not transmitted to the clutch coupling 700 due to separation of the clutch coupling 700 from the clutch boss 800. As a result, the housing gear 510 and spin-drying shaft 550, which are connected to the clutch coupling 700, do not rotate. Since the spin-drying shaft 550 does not rotate, the rotating tub 40 (FIG. 1) also does not rotate.

Thus, only the pulsator 45 rotates without rotation of the rotating tub 40, to stir laundry loaded in the rotating tub 40 together with wash water, and, as such, the laundry is washed.

Figure 9:
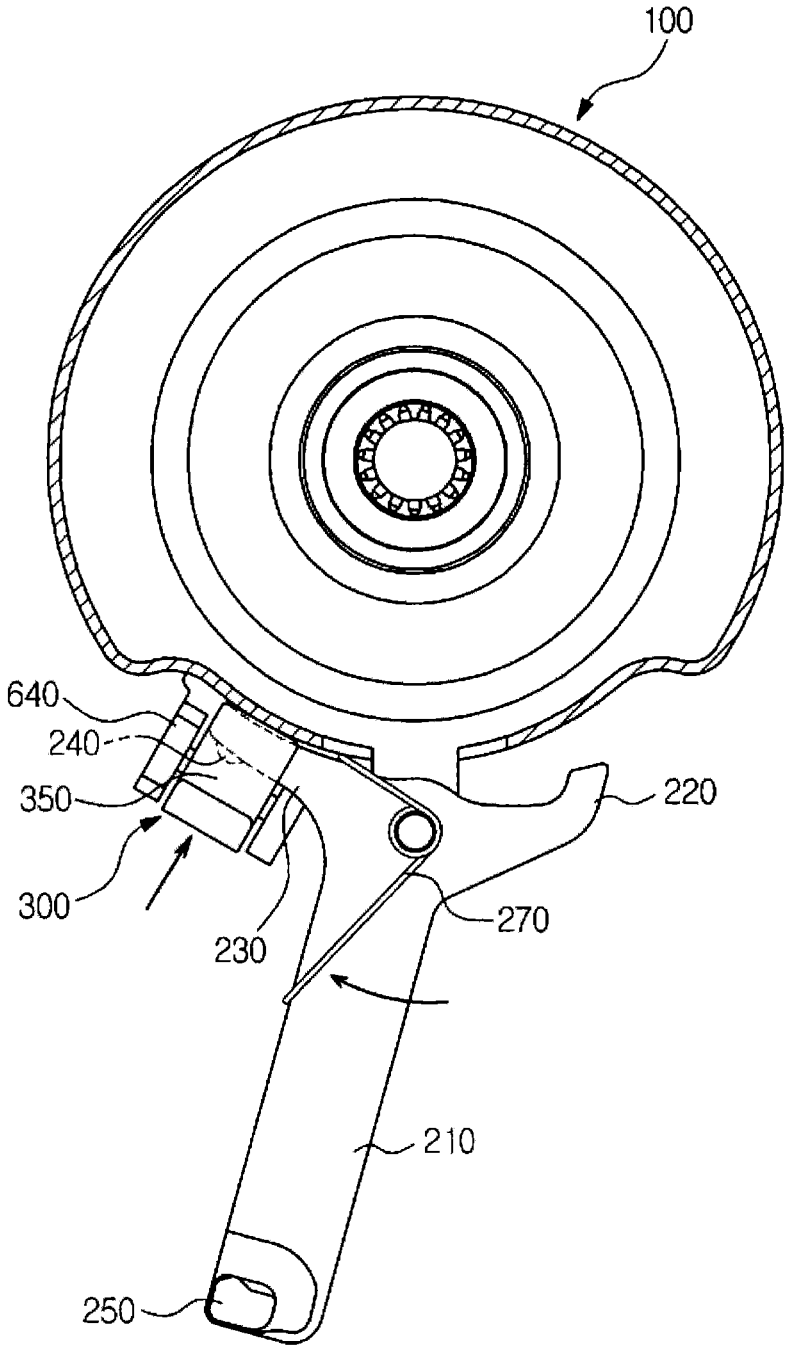
FIGS. 9 and 10 are views illustrating operations of the clutch assembly during spin drying in accordance with an embodiment of the present disclosure.
Figure 10:
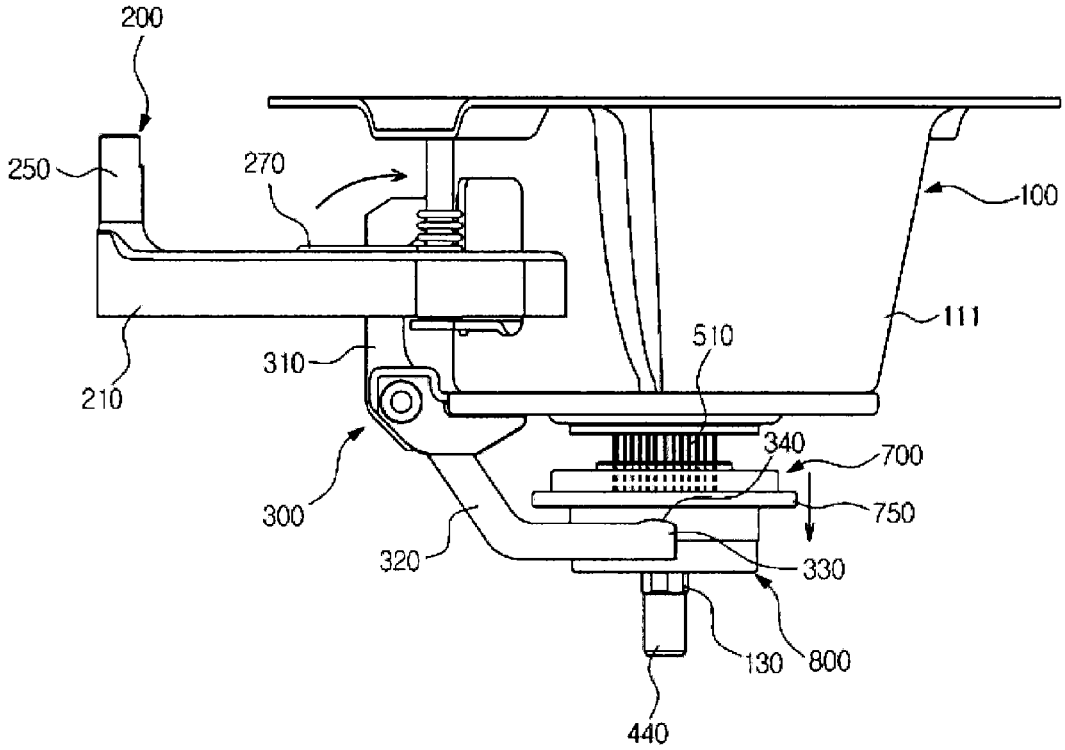

FIGS. 9 and 10 are views illustrating operations of the clutch assembly during spin drying in accordance with an embodiment of the present disclosure.

During spin drying, the rotating tub 40 (FIG. 1) and the pulsator 45 (FIG. 1) disposed within the rotating tub 40 rotate simultaneously, to separate moisture from the laundry by centrifugal force.

As shown in FIGS. 3, 9 and 10, the lever driver (not shown) pulls the connector 250 of the clutch lever 200, to pivotally move the clutch lever 200 toward the lever guide 230. In accordance with the pivotal movement of the clutch lever 200, the lever guide 230 comes into contact with the housing side surface 111. As a result, the lever guide 230 no longer pushes the upper lever portion 310.

When external force applied to the coupling lever 300 is released, the coupling guide 330 and clutch coupling 700 are downwardly moved by the first elastic member 370 and coupling elastic member 760.

The clutch coupling 700 is downwardly moved until it is coupled to the clutch boss 800. Accordingly, the boss protrusions 820 are inserted into the coupling grooves 740, thereby causing the clutch coupling 700 to be firmly coupled to the clutch boss 800.

The downward movement of the clutch coupling 700 is continued until the clutch coupling 700 comes into contact with the upper surface of the clutch boss 800.

The coupling guide 330 of the coupling lever 300 is downwardly moved by the first elastic member 370, and the upper lever portion 310 is pivotally moved to a position adjacent to the housing side surface 111. The coupling lever 300 is pivotally moved until the first stopper 350 comes into contact with the housing side surface 111.

In a state in which the downward movement of the clutch coupling 700 and the pivotal movement of the coupling lever 300 are completed, the first contact protrusions 340 of the coupling guide 330 may be spaced apart from the lower surface of the seat 750 of the clutch coupling 700 by a certain distance.

When the lower shaft 400 connected to the motor 70 (FIG. 1) is rotated by drive force from the motor 70, the clutch boss 800 and washing shaft 450, which are connected to the lower shaft 400, are rotated. When the washing shaft 450 rotates, the pulsator 45 (FIG. 1) also rotates.

Since the clutch boss 800 is in a state of being coupled to the clutch coupling 700, the clutch coupling 700 is rotated together with the clutch boss 800. When the clutch coupling 700 rotates, the housing gear 510 engaged with the coupling teeth 710 of the clutch coupling 700 is also rotated. In accordance with rotation of the housing gear 510, the spin-drying shaft 550 is rotated. The rotating tub 40 (FIG. 1) connected to the spin-drying shaft 550 is also rotated.

Thus, the rotating tub 40 and pulsator 45 rotate simultaneously and, as such, spin drying of the laundry loaded in the rotating tub 40 is carried out.

As apparent from the above description, the clutch assembly has a simple structure in that it includes the clutch coupling and the clutch lever to control the coupling lever.

It may be possible to control pivotal movement of the clutch lever, using the second stopper formed at the clutch lever.

Since the clutch boss is separate from the motor, it may be possible to apply the clutch assembly to various types of motors.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a tub disposed within the cabinet, to store wash water;

a rotating tub rotatably disposed within the tub;

a pulsator rotatably disposed within the rotating tub;

a motor disposed beneath the tub, to provide power for rotation of the rotating tub and the pulsator; and a clutch assembly disposed between the motor and the rotating tub, wherein the clutch assembly comprises a clutch coupling movable vertically between upper and lower positions to transmit the power from the motor to at least one of the rotating tub and the pulsator, a coupling lever movable pivotally to vertically move the clutch coupling, and a clutch lever movable pivotally and operatively connected to the coupling lever to pivotally move the coupling lever, wherein the clutch lever comprises a lever body, a stopper to limit a pivotal movement range of the clutch lever, a lever guide to selectively contact the coupling lever, for the operative connection of the clutch lever to the coupling lever, and a rotation center hole, each of the lever body, stopper and lever guide extending radially outward from the rotation center hole and pivoting with respect to the rotation center hole.

2. The washing machine according to claim 1, wherein the clutch lever further comprises an elastic member to elastically bias the clutch lever in one side.

3. The washing machine according to claim 1, wherein the lever guide pushes the coupling lever, to pivotally move the coupling lever.

4. The washing machine according to claim 3, wherein the lever guide comprises a contact protrusion to enable the coupling lever to move pivotally while being pushed by the lever guide.

5. The washing machine according to claim 1, wherein the clutch lever moves pivotally on a horizontal plane.

6. The washing machine according to claim 5, wherein the coupling lever moves pivotally a vertical plane in a state of being operatively connected to the clutch lever.

7. The washing machine according to claim 6, wherein the coupling lever comprises a coupling guide provided at a lower end of the coupling lever, to vertically move the clutch coupling.

8. The washing machine according to claim 1, wherein the clutch assembly comprises:

a washing shaft connected to the motor, to transmit the power from the motor to the pulsator; and a spin-drying shaft connected to the clutch coupling, to rotate the rotating tub when the clutch coupling rotates.

9. The washing machine according to claim 8, further comprising:

a clutch boss coupled to a lower end of the washing shaft, to rotate together with the washing shaft.

10. The washing machine according to claim 9, wherein:

the clutch coupling moves downwardly to the lower position in accordance with corresponding pivotal movements of the clutch lever and the coupling lever operatively connected to the clutch lever;

the clutch coupling is coupled to the clutch boss at the lower position of the clutch coupling;

the washing shaft, the clutch boss and the clutch coupling are rotated by the power from the motor in accordance with the coupling of the clutch coupling to the clutch boss;

the spin-drying shaft is rotated in accordance with the rotation of the clutch coupling; and the pulsator is rotated in accordance with the rotation of the washing shaft, and the rotating tub is rotated in accordance with the rotation of the spin-drying shaft.

11. The washing machine according to claim 10, wherein:

the clutch coupling moves upwardly to the upper position in accordance with corresponding pivotal movements of the clutch lever and the coupling lever operatively connected to the clutch lever;

the clutch coupling is separated from the clutch boss at the upper position of the clutch coupling;

the washing shaft is rotated by the power from the motor, and the clutch coupling and the spin-drying shaft do not rotate in accordance with the separation of the clutch coupling from the clutch boss; and the pulsator is rotated in accordance with the rotation of the washing shaft, and the rotating tub is maintained in a stopped state.

12. The washing machine according to claim 9, wherein the clutch boss is separate from the motor.

13. A washing machine comprising:

a cabinet;

a tub disposed within the cabinet, to store wash water;

a rotating tub rotatably disposed within the tub;

a pulsator rotatably disposed within the rotating tub;

a motor disposed beneath the tub, to provide power for rotation of the rotating tub and the pulsator; and a clutch assembly disposed between the motor and the rotating tub, wherein the clutch assembly comprises a clutch coupling movable vertically between upper and lower positions to transmit the power from the motor to at least one of the rotating tub and the pulsator, and a clutch boss disposed beneath the clutch coupling such that the clutch boss is separated from the clutch coupling when the clutch coupling moves upwardly to the upper position, while being coupled to the clutch coupling when the clutch coupling moves downwardly to the lower position, a coupling lever movable pivotally to vertically move the clutch coupling, and a clutch lever movable pivotally and operatively connected to the coupling lever to pivotally move the coupling lever, the clutch lever comprising a lever body, a stopper to limit a pivotal movement range of the clutch lever, a lever guide to selectively contact the coupling lever, for the operative connection of the clutch lever to the coupling lever, and a rotation center hole, each of the lever body, stopper and lever guide extending radially outward from the rotation center hole and pivoting with respect to the rotation center hole.

14. The washing machine according to claim 13, wherein the clutch boss is separate from the motor.

15. The washing machine according to claim 13, wherein:

the rotating tub and the pulsator rotate simultaneously when the clutch boss is coupled to the clutch coupling; and only the rotating tub rotates when the clutch boss is separated from the clutch coupling.

* * * * *